US006802373B2

(12) United States Patent
Dillenbeck et al.

(10) Patent No.: US 6,802,373 B2
(45) Date of Patent: Oct. 12, 2004

(54) APPARATUS AND METHOD OF DETECTING INTERFACES BETWEEN WELL FLUIDS

(75) Inventors: Robert Lee Dillenbeck, Spring, TX (US); Bradley T. Carlson, Cypress, TX (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 10/120,201

(22) Filed: Apr. 10, 2002

(65) Prior Publication Data

US 2003/0192695 A1 Oct. 16, 2003

(51) Int. Cl.[7] ..... E21B 33/13; E21B 47/06

(52) U.S. Cl. ..... 166/255.1; 166/66; 166/177.4; 166/250.03; 166/250.12; 166/250.14; 166/285

(58) Field of Search ..... 166/255.1, 250.03, 166/250.04, 250.12, 250.14, 177.4, 66, 285, 291, 70, 252.6

(56) References Cited

U.S. PATENT DOCUMENTS

| | | | | |
|---|---|---|---|---|
| 2,004,606 A | | 6/1935 | Halliburton | 166/21 |
| 2,071,396 A | | 2/1937 | Engel | 12/7 |
| 2,141,370 A | | 12/1938 | Armentrout et al. | 166/1 |
| 2,161,284 A | | 6/1939 | Crowell | 166/1 |
| 2,169,356 A | | 8/1939 | Dyer | 166/1 |
| 2,217,708 A | | 10/1940 | Scaramucci | |
| 4,206,810 A | | 6/1980 | Blackman | 166/336 |
| 4,468,967 A | | 9/1984 | Carter, Jr. | 73/661 |
| 4,638,278 A | | 6/1987 | Bullock | 35/207 |
| 4,928,520 A | | 5/1990 | Barrington | 73/151 |
| 5,191,932 A | | 3/1993 | Seefried et al. | 166/291 |
| 5,252,918 A | | 10/1993 | VanBerg et al. | 324/207 |
| 5,323,856 A | * | 6/1994 | Davis et al. | 166/253.1 |
| 5,890,538 A | | 4/1999 | Beirute et al. | 166/285 |
| 5,967,231 A | | 10/1999 | Laurel et al. | 166/250 |
| 6,125,935 A | * | 10/2000 | Shahin, Jr. | 166/250.14 |
| 6,244,342 B1 | | 6/2001 | Sullaway et al. | 166/285 |
| 6,302,199 B1 | | 10/2001 | Hawkins et al. | 166/70 |
| 6,401,814 B1 | * | 6/2002 | Owens et al. | 166/253.1 |
| 2002/0157828 A1 | * | 10/2002 | King et al. | 166/285 |
| 2002/0174985 A1 | * | 11/2002 | Vincent et al. | 166/285 |
| 2003/0029611 A1 | * | 2/2003 | Owens | 166/250.03 |
| 2003/0062155 A1 | * | 4/2003 | Summers | 166/66 |
| 2003/0192690 A1 | | 10/2003 | Carlson et al. | 166/250 |

OTHER PUBLICATIONS

Model GN 201 & 202 Ball Injector; GN Machine Works; Feb. 1986.

"*Reverse Circulation of Cement on Primary Jobs Increases Cement Column Height Across Weak Formations*", Griffith, J.E., © 1993, SPE 25440, The SPE Image Library.

"*Primary Cementing by Reverse Circulation Solves Critical Problem in the North Hassi–Messaoud Field, Algeria*", Journal of Petroleum Technology, Feb. 1966.

* cited by examiner

*Primary Examiner*—Hoang Dang
(74) *Attorney, Agent, or Firm*—Howrey Simon Arnold & White, LLP

(57) ABSTRACT

An apparatus for use in circulating cement in a casing in a wellbore is described having a first component such as a sensor disposed on the casing and a second component such as a detectable device disposed at a fluid interface formed between the cement and a fluid. The sensor may be a sensor coil mounted on the perimeter of the lower end of the casing, while the detectable device may be a transponder capable of emitting Radio Frequency Identification signals to the sensor to signal its arrival at the lower end of the casing. The transponder may be encased in a protective covering. Also described is a method of cementing a casing utilizing a first component such as a sensor disposed on the casing and a second component such as a detectable device disposed in the cement.

18 Claims, 12 Drawing Sheets

APPARATUS AND METHOD OF DETECTING INTERFACES BETWEEN WELL FLUIDS

BACKGROUND OF THE INVENTION

1. Field of the Invention

The invention relates to an apparatus and method for use in the field of oil and gas recovery. More particularly, this invention relates to an apparatus having a first component such as a sensor and a second component such as a detectable device or material adapted to determine when a general interface region between two dissimilar fluids has passed a given point in a well.

2. Description of the Related Art

Cementing a wellbore is a common operation in the field of oil and gas recovery. Generally, once a wellbore has been drilled, a casing is inserted and cemented into the wellbore to seal off the annulus of the well and prevent the infiltration of water, among other things. A cement slurry is pumped down the casing and back up into the space or annulus between the casing and the wall of the wellbore. Once set, the cement slurry prevents fluid exchange between or among formation layers through which the wellbore passes and prevents gas from rising up the wellbore. This cementing process may be performed by circulating a cement slurry in a variety of ways.

For instance, it is generally known that a conventional circulating cementing operation may be performed as follows. First the liquid cement slurry is pumped down the inside of the casing. Once the desired amount of cement has been pumped inside the casing, a rubber wiper plug is inserted inside the casing. A non-cementacious displacement fluid, such as drilling mud, is then pumped into the casing thus forcing the rubber wiper plug toward the lower end of the casing. Concomitantly, as the displacement fluid is pumped behind it, the rubber wiper plug pushes or displaces the cement slurry beneath it all the way to the bottom of the casing string. Ultimately, the cement is forced for some distance up into the annulus area formed between the outside the casing and the wellbore. Typically, the end of the job is signaled by the wiper plug contacting a restriction inside the casing at the bottom of the string. When the plug contacts the restriction, a sudden pump pressure increase is seen at the surface. In this way, it can be determined when the cement has been displaced from the casing and fluid flow returning to the surface via the casing annulus stops.

The restriction inside the bottom of the casing that stops the plug in this conventional cement circulation procedure is usually a type of one-way valve, such as a float collar or a float shoe, that precludes the cement slurry from flowing back inside the casing. The valve generally holds the cement in the annulus until the cement hardens. The plug and the valve may then be drilled out.

Further, it is known that the time the end of the cement slurry leaves the lower end of the casing (i.e. when the operation is complete) may be estimated, as the inner diameter, length, and thus the volume of the casing as well as the flow rate of the cement slurry and displacement fluids are known.

The conventional circulating cementing process may be time-consuming, and thus relatively expensive, as cement must be pumped all the way to the bottom of the casing and then back up into the annulus. Further, expensive chemical additives, such as curing retarders and cement fluid-loss control additives, are typically used, again increasing the cost. The loading of these expensive additives must be consistent through the entire cement slurry so that the entire slurry can withstand the high temperatures encountered near the bottom of the well. This again increases cost. Finally, present methods of determining when the slurry leaves the lower end of the casing generally require attention and action from the personnel located at the surface and may be inaccurate in some applications. For instance, if the plug were to encounter debris in the casing and became lodged in the casing, personnel at the surface could incorrectly conclude the cement had left the lower end of the casing and job was completed. In other applications, the plug may accidentally not be pumped into the casing. Thus, in some applications, it is known to attach a short piece of wire to the rubber wiper plug. Personnel on the surface may then monitor the wire, and once the entire wire is pulled into the wellbore, the surface personnel know the plug has entered the casing. However, this system only verifies that the plug has entered the casing, not that the plug has reached the bottom.

A more recent development is referred to as reverse circulating cementing. The reverse circulating cementing procedure is typically performed as follows. The cement slurry is pumped directly down the annulus formed between the casing and the wellbore. The cement slurry then forces the drilling fluids ahead of the cement displaced around the lower end of the casing and up through the inner diameter of the casing. Finally, the drilling mud is forced out of the casing at the surface of the well.

The reverse circulating cementing process is continued until the cement approaches the lower end of the casing and has just begun to flow upwardly into the casing. Present methods of determining when the cement reaches the lower end of the casing include the observation of the variation in pressure registered on a pressure gauge, again at the surface. A restricted orifice is known to be utilized to facilitate these measurements.

In other reverse circulation applications, various granular or spherical materials of pre-determined sizes may be introduced into the first portion of the cement. The shoe may have orifices also having predetermined sizes smaller than that of the granular or spherical materials. The cement slurry's arrival at the shoe is thus signaled by a "plugging" of the orifices in the bottom of the casing string. Another, less exact, method of determining when the fluid interface reaches the shoe is to estimate the entire annular volume utilizing open hole caliper logs. Then, pumping at the surface may be discontinued when the calculated total volume has been pumped down the annulus.

In the reverse circulating cementing operation, cementing pressures against the formation are typically much lower than conventional cementing operations. The total cementing pressure exerted against the formation in a well is equal to the hydrostatic pressure plus the friction pressure of the fluids' movement past the formation and out of the well. Since the total area inside the casing is typically greater than the annular area of most wells, the frictional pressure generated by fluid moving in the casing and out of the well is typically less than if the fluid flowed out of the well via the annulus. Further, in the reverse circulating cementing operation, the cement travels the length of the string once, i.e. down the annulus one time, thus reducing the time of the cementing operation.

However, utilizing the reverse circulating cementing operation presents its own operational challenges. For instance, since the cement slurry is pumped directly into the annulus from the surface, no conventional wiper plug can be used to help displace or push the cement down the annulus. With no plug, there is nothing that will physically contact an obstruction to stop flow and cause a pressure increase at the surface.

Further, unlike the conventional circulating cementing process where the inner diameter of the casing is known, the inner diameter of the wellbore is not known with precision, since the hole is typically washed out (i.e. enlarged) at various locations. With this variance of the inner diameter of the wellbore, one cannot precisely calculate the volume of cement to reach the bottom of the casing, even when using open hole caliper logs.

Other methods of determining when the cement slurry has reached the lower end of the wellbore are known. For instance, it is known that the restrictor discussed above may comprise a sieve-like device having holes through which the drilling mud may pass. Ball sealers—rubber-covered nylon balls that are too large to go through those holes—are mixed into the cement at the mud/cement interface. In operation, as the mud/cement interface reaches the lower end of the casing, the ball sealers fill the holes in the sieve-like device, and changes in pressure are noticed at the surface thus signaling the end of the operation. Again, erroneous results may be produced from this system. The wellbore is typically far from pristine and typically includes various contaminants (i.e. chunks of shale or formation rock that are sloughed off of walls of the wellbore) that can plug the holes. Once the holes are plugged, the flow of cement and drilling mud ceases, even though the cement interface has not reached the lower end of the casing. Also problematic is that fact that once any object is inserted into the casing, or annulus for that matter, its precise location of that object is no longer known with certainty. The accuracy of its whereabouts depends upon the quality and quantity of the instrumentation utilized at the surface.

From the above is can be seen that in either the conventional or reverse circulation cementing process, it is important to determine the exact point at which the cement completely fills the annulus from the bottom of the casing to the desired point in the annulus so that appropriate action may be taken. For instance, in the conventional circulation cement process, if mud continues to be pumped into the casing after the mud/cement interface reaches the lower end of the casing, mud will enter the annulus thus contaminating the cement and jeopardizing the effectiveness of the cement job.

Similarly, in the reverse circulating cementing process, if cement—or displacement fluids—continue to be pumped from the surface once the mud/cement interface reaches the lower end of the casing, excessive cement will enter the interior of the casing. Drilling or completion operations will be delayed while the excess cement inside the casing is drilled out.

Thus, a need exists for a more accurate system and method of determining the location of an interface between two fluids with respect to the wellbore. Particularly, in a cementing operation, a need exists for a more accurate apparatus and method of determining when the mud/cement interface, or the spacer/cement interface, reaches the lower end of a casing. Preferably, the apparatus and method will not rely on manual maneuvering at the surface of the well. Further, the apparatus and method should be able to be utilized with both the conventional circulating cementing operation and the reverse circulating cementing operation. Further, this apparatus preferably does not rely heavily on manual operations, nor operations performed at the surface.

Further, there is a need for an apparatus that performs the function of detecting when the mud/cement interface, or spacer/cement interface, reaches the lower end of the casing and, once the cement slurry is detected, will prevent any more fluid from being pumped. The system should be capable of operation without manual intervention from the surface.

SUMMARY OF THE INVENTION

The invention relates to a system and a method for determining the location of an interface between two fluids within a wellbore. A circulating cementing apparatus is described for cementing a casing in a wellbore. In some aspects, the apparatus comprises a first component disposed substantially on a lower end of the casing, a second component disposed substantially adjacent a fluid interface formed between a fluid and a cement slurry, the first component and the second component adapted to be in communication with each other as the second component is substantially adjacent the lower end of the casing, and a valve disposed within the casing, the first component adapted to close the valve when the first component and the second component communicate as the fluid interface reaches the lower end of the casing.

In some embodiments, the first component is a sensor and the second component is a detectable device. In others, the sensor comprises a sensor coil adapted to be mountable within the inner diameter of the lower end of the casing or around an outer perimeter of lower end of the casing. Or the sensor may be housed within a rubber wiper plug, the rubber wiper plug being adjacent the fluid interface.

In some embodiments, the detectable device is a transponder adapted to send a Radio Frequency Identification signal to the sensor coil. The transponder may be implanted into a protective device, such as a rubber ball. The apparatus may include a host electronics package, the host electronics package adapted to receive a signal from the sensor and to send to a signal to the valve to close the valve.

Also described is a fluid interface detecting system for cementing a casing in a wellbore, the system comprising a means for traveling within the wellbore along the casing, the means for traveling being adjacent a fluid interface, being defined between a cement slurry and a fluid; a means for sensing the means for traveling, the means for sensing being positioned on a lower end of the casing, the means for sensing adapted to detect the means for traveling as the means for traveling approaches the lower end of the casing; and a valve disposed within the casing, the means for sensing closing the valve when the means for sensing detects the means for traveling as the fluid interface approaches the lower end of the casing.

Also described is a method of cementing a casing having a lower end in a wellbore, using a reverse circulating cementing process, comprising placing the casing into the wellbore, the wellbore being filled with a fluid, the casing having a first component located at the lower end of the casing, the casing having a valve, pumping cement down an annulus defined between the outer perimeter of the casing and the wellbore, the cement contacting the fluid at a fluid interface, the fluid interface containing a second component, the first and second components adapted to be in communication when the second component reached the lower end of the casing, the pumping of the cement continuing until the first component and the second component communicate, and closing the valve by sending a signal from the first component to the valve, thus halting the flow of fluid through the casing in the wellbore, the cement being positioned in the annulus. In some embodiments, the first component is a sensor and the second component is a detectable device.

Figure 1A:
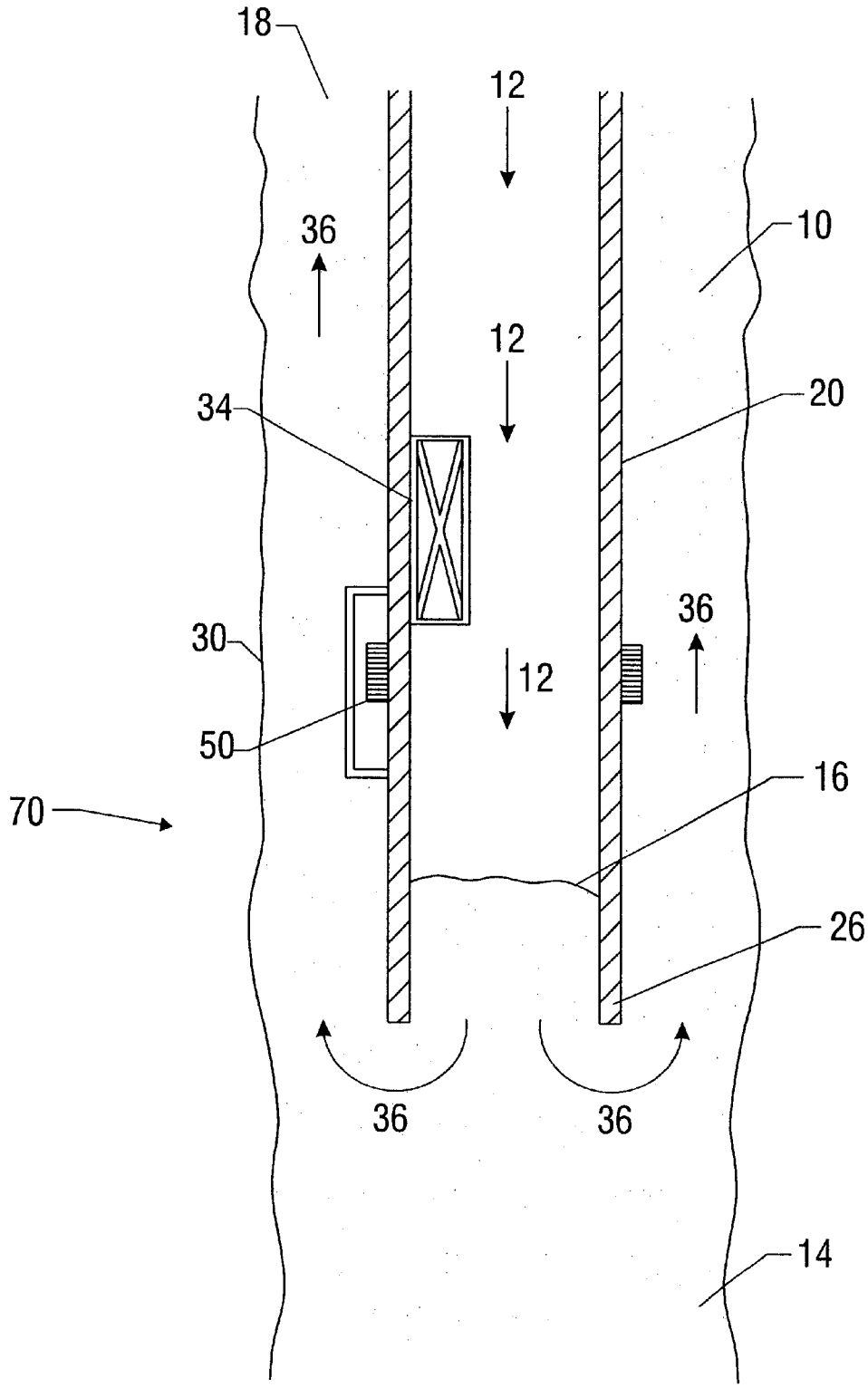
FIGS. 1A and 1B show one embodiment of the present invention used in conjunction with the conventional circulating cementing operation.

While the invention is susceptible to various modifications and alternative forms, specific embodiments have been shown by way of example in the drawings and will be described in detail herein. However, it should be understood that the invention is not intended to be limited to the particular forms disclosed. Rather, the intention is to cover all modifications, equivalents and alternatives falling within the spirit and scope of the invention as defined by the appended claims.

DESCRIPTION OF ILLUSTRATIVE EMBODIMENTS

Illustrative embodiments of the invention are described below as they might be employed in the oil and gas recovery operation. In the interest of clarity, not all features of an actual implementation are described in this specification. It will of course be appreciated that in the development of any such actual embodiment, numerous implementation-specific decisions must be made to achieve the developers' specific goals which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments of the invention will become apparent from consideration of the following description and drawings.

Figure 1B:
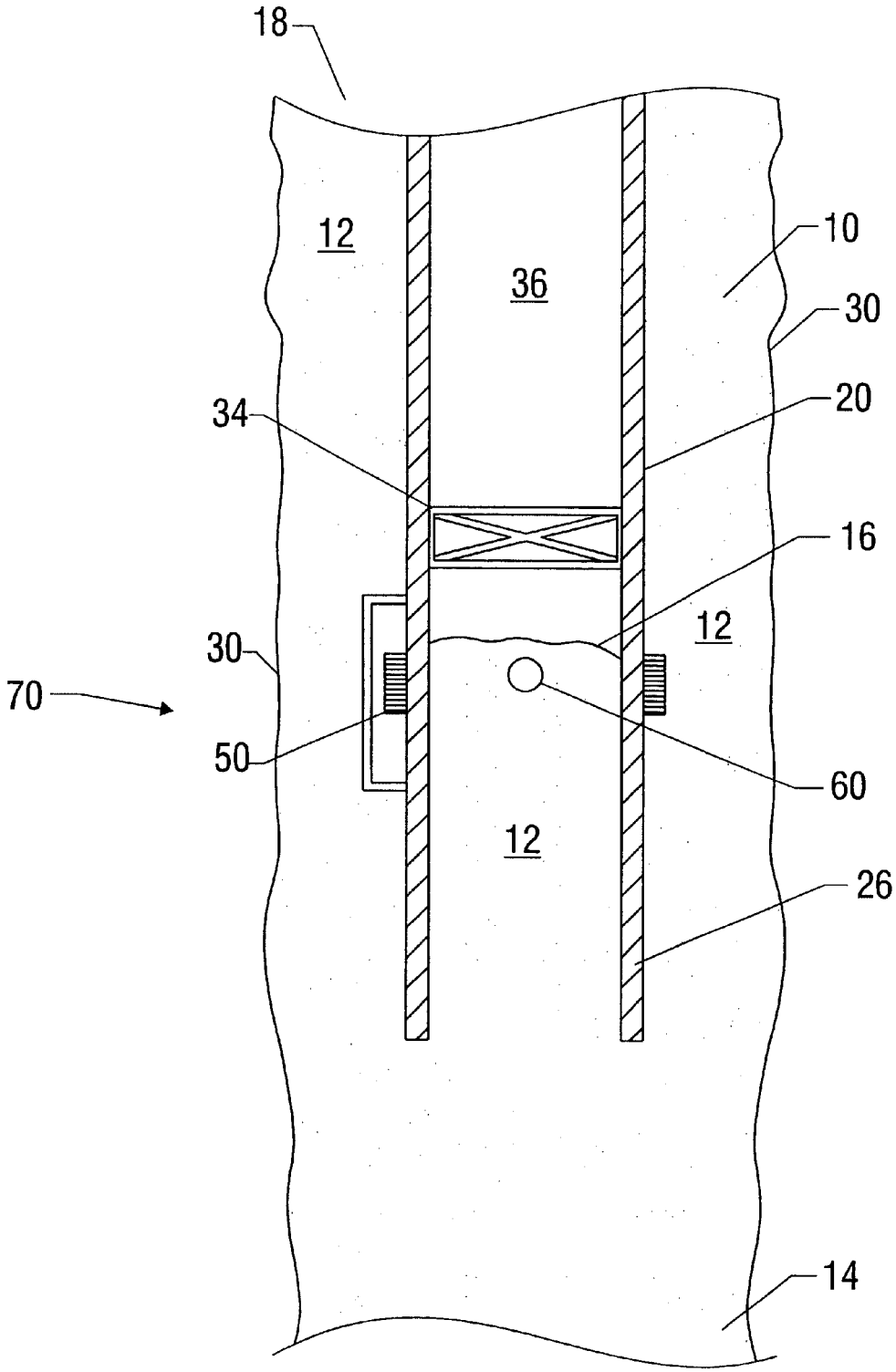

Embodiments of the invention will now be described with reference to the accompanying figures. Referring to FIGS. 1A and 1B, one embodiment of the present invention is shown being utilized with the conventional circulating cementing process described above. The cement slurry 12 is shown being pumped from the surface 18 into the casing 20. As shown in FIG. 1A, the cement slurry 12 pushes the drilling mud 36 down the casing toward the reservoir 14 and up an annulus 10 formed between the outer diameter of the casing 20 and the wellbore 30. As shown in FIG. 1A, the cement slurry 12 is approaching lower end 26 of casing 20. In FIG. 1A, valve 34 is shown in its open position thus allowing fluid to pass through the casing 20.

FIG. 1B shows that embodiment of FIG. 1A after a predetermined amount of cement slurry 12 has been pumped into the casing 20. Once this predetermined amount of cement slurry 12 has been pumped into the casing 20, and prior to the pumping of non-cementacious displacement fluid, such as drilling fluid 36 is pumped into the casing, a detectable device or material 60 is placed in the cement slurry substantially adjacent the fluid interface 16 formed between the cement slurry 12 and the non-cementacious fluid, such as drilling fluid 36. As the displacement fluid, such as drilling fluid 36, continues to be pumped into the casing, the fluid interface approaches a sensor 50 placed near the lower end 26 of casing 20. As the fluid interface 16 reaches the lower end 26 of casing 20, sensor 50 and detectable device or material 60 interact—as more fully described herein—and the fluid interface detecting system 70 causes valve 34 to close. Valve 34 is shown in its closed position in FIG. 1B. The closing of valve 34 causes a sudden increase in pump pressure is seen at the surface to further affirm that the cement slurry 12 is at the desired location in annulus 10 and is ready to set. A two-way valve (not shown) may be utilized to prevent fluid flow in either direction when closed.

It should be mentioned that the fluid interface 16 is not necessarily a discreet plane formed be the cement slurry 12 and the non-cementacious displacement fluid, such as drilling fluid 36. Typically, some mixing will naturally occur between the cement slurry and the non-cementacious displacement fluid as the cementing process occurs. However, generally, this area of mixing of the two fluids is limited to a few linear vertical feet in a typical cementing operation.

Figure 2A:
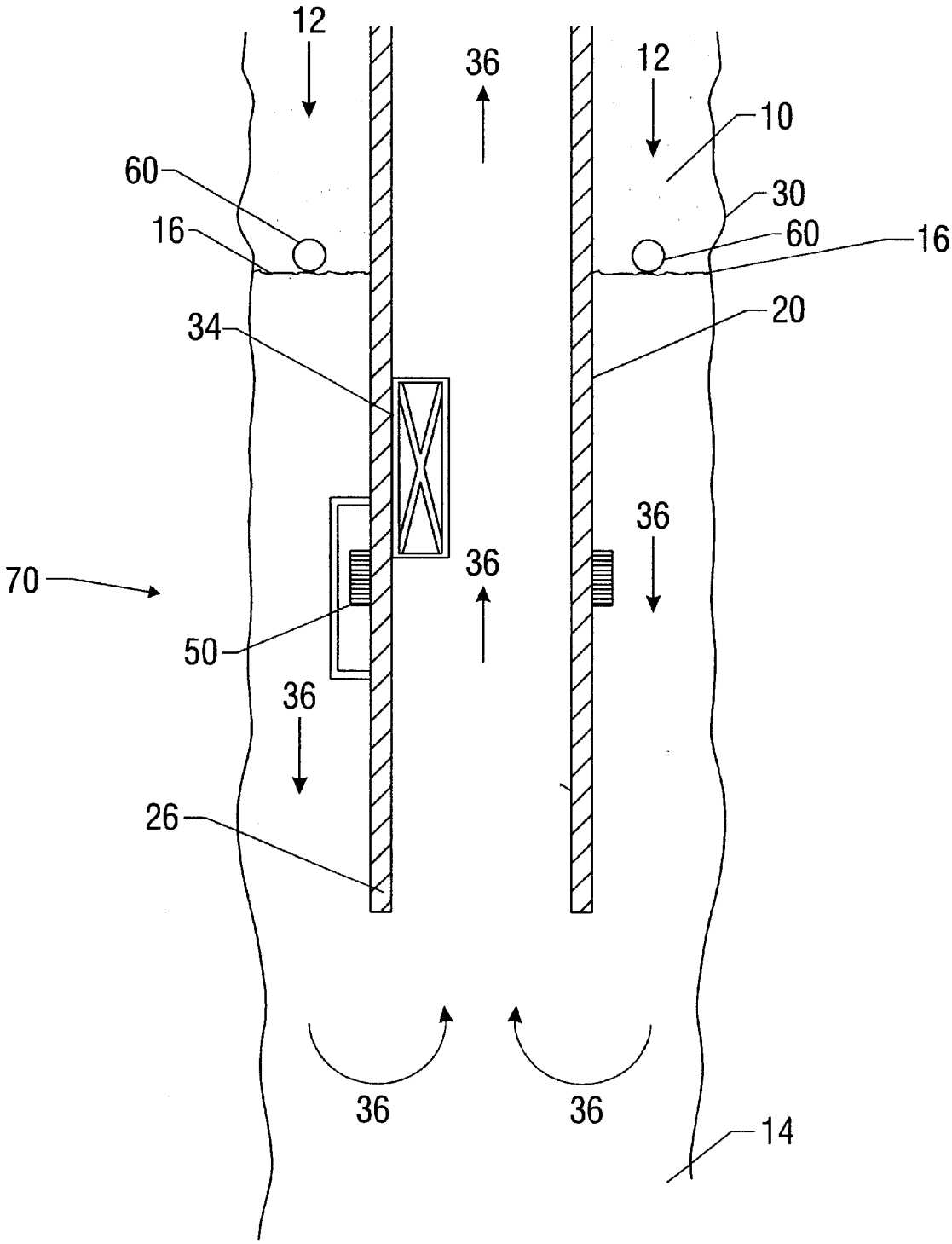
FIGS. 2A and 2B show one embodiment of the present invention used in conjunction with the reversed circulating cementing operation.
Figure 2B:
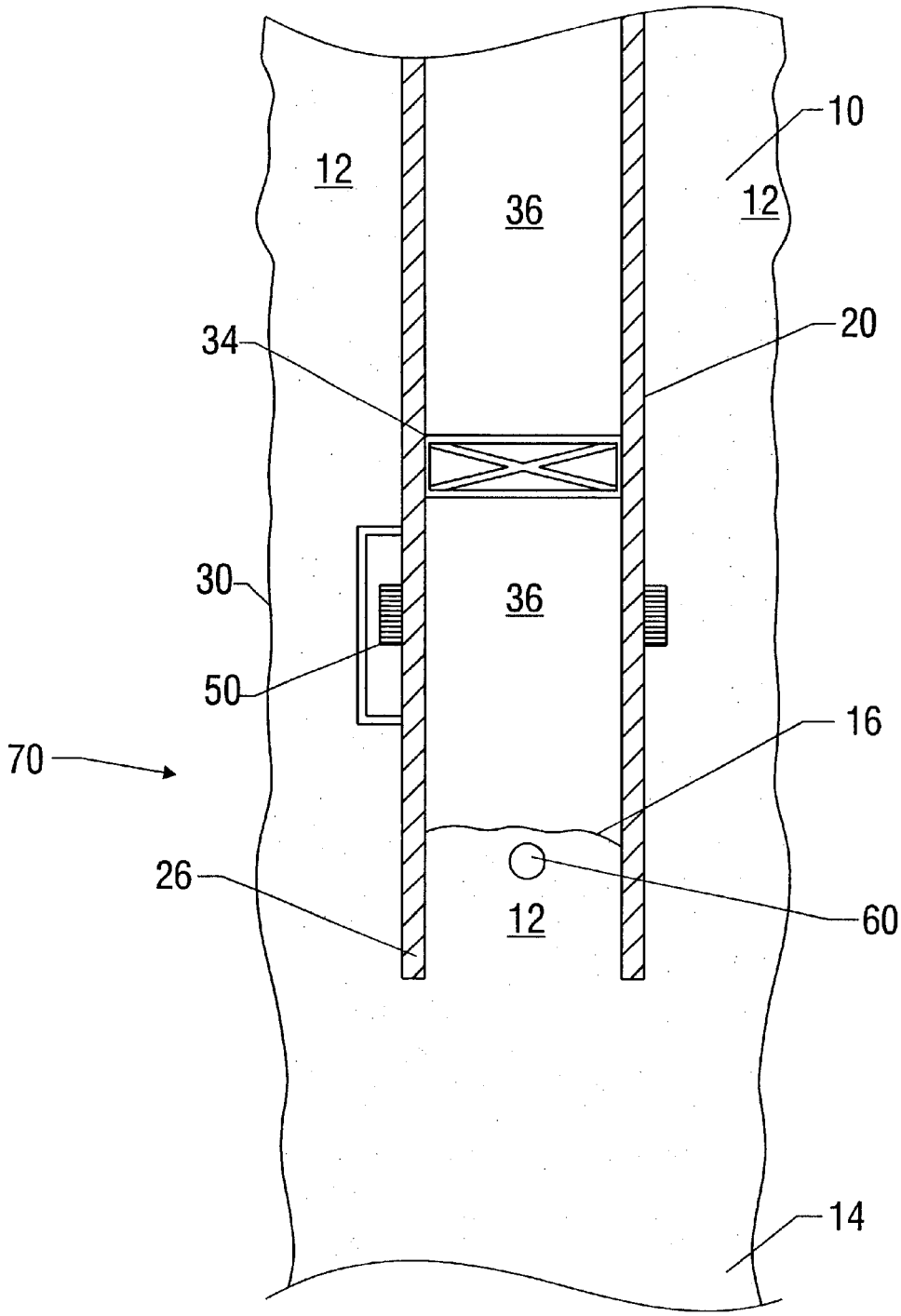

FIGS. 2A and 2B show an embodiment of the present invention being utilized in the reverse circulating cementing operation described above. As shown in FIGS. 2A and 2B, a first component, such as sensor 50, is mounted adjacent the lower end 26 of casing 26. As shown in FIG. 2A, the cement slurry 12 is being pumped directly down the annulus 10 which is formed between casing 20 and wellbore 30. In this embodiment, a second component such as detectable device or material 60, is placed in the cement slurry 12 near the fluid interface 16 formed between the cement slurry 12 and the drilling mud 36. Return fluids, such as drilling mud 36, are shown concurrently circulating up the inside of the casing 20. Cement slurry 12 is pumped into annulus 10 until the fluid interface 16 between cement slurry 12 and the drilling mud 36 reaches the lower end 26 of casing 20. Once the fluid interface 16 reaches the lower end 26 of casing 26, the first component, such as sensor 50 of the fluid interface detecting apparatus 70 interacts with the detectable device or material 60—as more fully described herein. The fluid interface detecting system 70 then closes a valve 34 inside casing 20 to prevent the cement slurry 12 from further entering the casing 20.

Again, the closing of valve 34 causes return flow of drilling mud 36 up the casing 20 to abruptly cease. The closing of valve 34 may also cause an increase in the surface pumping pressure in the annulus 10. These surface indications may then be used as additional positive indications of the proper placement of cement and hence the completion of the job.

Depending upon a given application, the sensor 50 may detect the detectable device 60 as it first approaches the lower end of the casing 20, i.e. while the detectable device 60 is in the annulus. However, in a preferred embodiment shown in the reverse circulating cementing operation, the detectable device 60 travels the length of casing 20 and enters the lower end 26 of casing 20 before being detected by sensor 50.

The following embodiments of the present invention may be utilized with the conventional circulating cementing process, the reverse circulating cementing process, or any other process involving fluid flow; however, only the reverse circulating cementing process is shown in the figures discussed unless otherwise stated. Further, the remaining figures show valve 34 in its closed position with the arrows showing the direction of fluid flow just immediately prior to the closing of valve 34; however, it is understood that as the fluids are flowing during the cementing operation, valve 34 is open as shown in FIGS. 1A and 2A.

Figure 3:
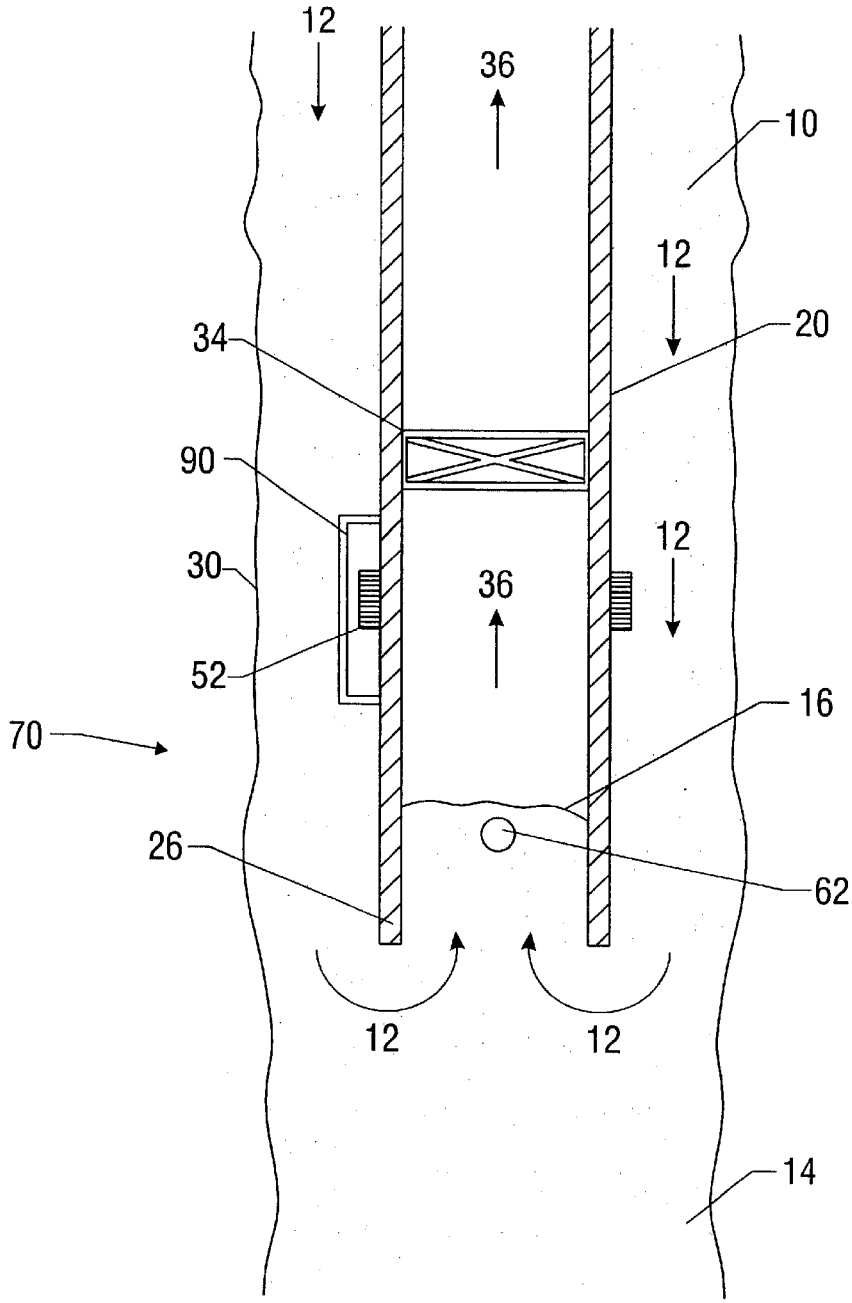
FIG. 3 shows an embodiment of the present invention that utilizes an sensor coil and a transponder.
Figure 4:
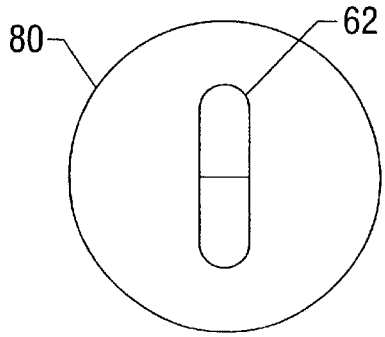
FIG. 4 shows a transponder of one embodiment of the present invention.

In one embodiment shown in FIG. 3, the fluid interface detecting apparatus comprises a sensor 50 and a detectable device or material 60. In one embodiment, the detectable device or material 60 comprises a Radio Frequency Identification ("R.F.I.D.") device such as a transponder 62 that is molded into any object, such as rubber ball 80 as shown in FIG. 4, which serves to protect the transponder from damage, among other things. Transponders 62 may (or may not be) molded or formed into any protective coating, such as being encapsulated in glass or ceramic. Transponders 62 may be any variety of commercially-available units, such as that offered by TEXAS INSTRUMENTS, part number P-7516. The rubber ball 80 may be molded from a material that is designed to be neutrally buoyant in cement. (i.e. having a specific gravity substantially similar to the designed cement slurry). The balls 80 are introduced into the leading edge of the cement slurry 12 at the surface as the cement is being pumped into the well (i.e. either into casing 20 for the conventional circulating cementing operation or into the annulus 10 in the case of the reverse circulating cementing operation). Thus, the balls 80 and thus the transponders 62 are placed at the fluid interface 16 between the cement slurry 12 and the drilling mud 36. Several balls 80 with transponders 62 may be used for the sake of redundancy.

In this embodiment shown in FIG. 3, the sensor 50 may be comprised of a sensor coil 52. In this embodiment, the sensor coil 52 is attached to the casing 20 to be cemented. The sensor coil 52 is shown on the lower end 26 of casing 20. The coil is shown on encircling the outer diameter of casing 20; however, the coil may also be attached on the inner diameter of the casing instead. The sensor coil 52 may be any type of sensor coil, such as ones that are commercially available from TEXAS INSTRUMENTS, "Evaluation Kit," part number P-7620. The sensor coil 52 may be tuned to resonate at the design frequency of the R.F.I.D. transponders 62. In some embodiments, this frequency is 134.2 Khz.

In this embodiment, a host electronics package 90 is electrically connected to the sensor coil 52 and continually sends a signal from the sensor coil 52 through the drilling mud and/or cement slurry seeking the R.F.I.D. transponders 62. Each transponder 62 has a unique identification number stored therein. When any R.F.I.D. transponder 62 passes near the sensor coil 52, that transponder 52 modulates the radio frequency field to send its unique identification numbers back to the host electronics package 70 via the sensor coil 52.

The host electronics 90 package is also in electrical communication with a valve 34. When the transponder 62 is detected by the host electronics package 90 via the sensing coil 52, the host electronics package 90 then sends a signal to close a valve 34 located in the casing 20. The closing of valve 34 in the casing 20 prevents cement flow into the casing 20. Further, the addition of fluid—i.e. drilling mud 36 in the case of the conventional circulating cementing operation and cement 12 in the case of the reversing circulating cementing—at the surface ceases. As an added safeguard, the completing of the cementing operation may be detected as a rapid rise in pressure at the surface.

Figure 5:
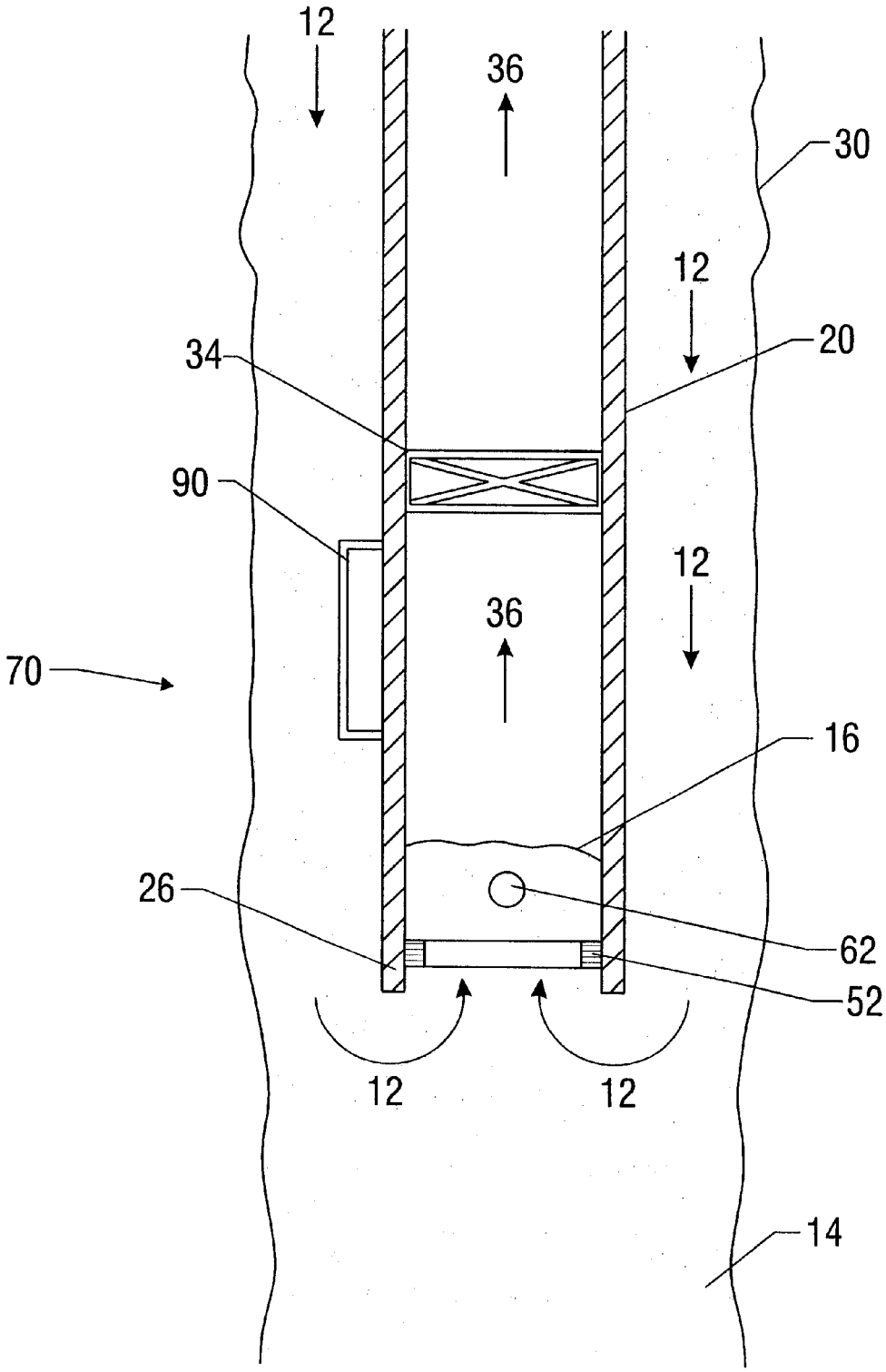
FIG. 5 shows an embodiment of the present invention that includes the sensor coil located within the casing.

It should be mentioned that in this embodiment, as is the case in all the embodiments shown, the sensor 50 may be mounted on the inside or on the outside of casing 20. For example, the sensor coil 52 is shown to be attachable to the inner diameter of casing 20 in FIG. 5.

Figure 6:
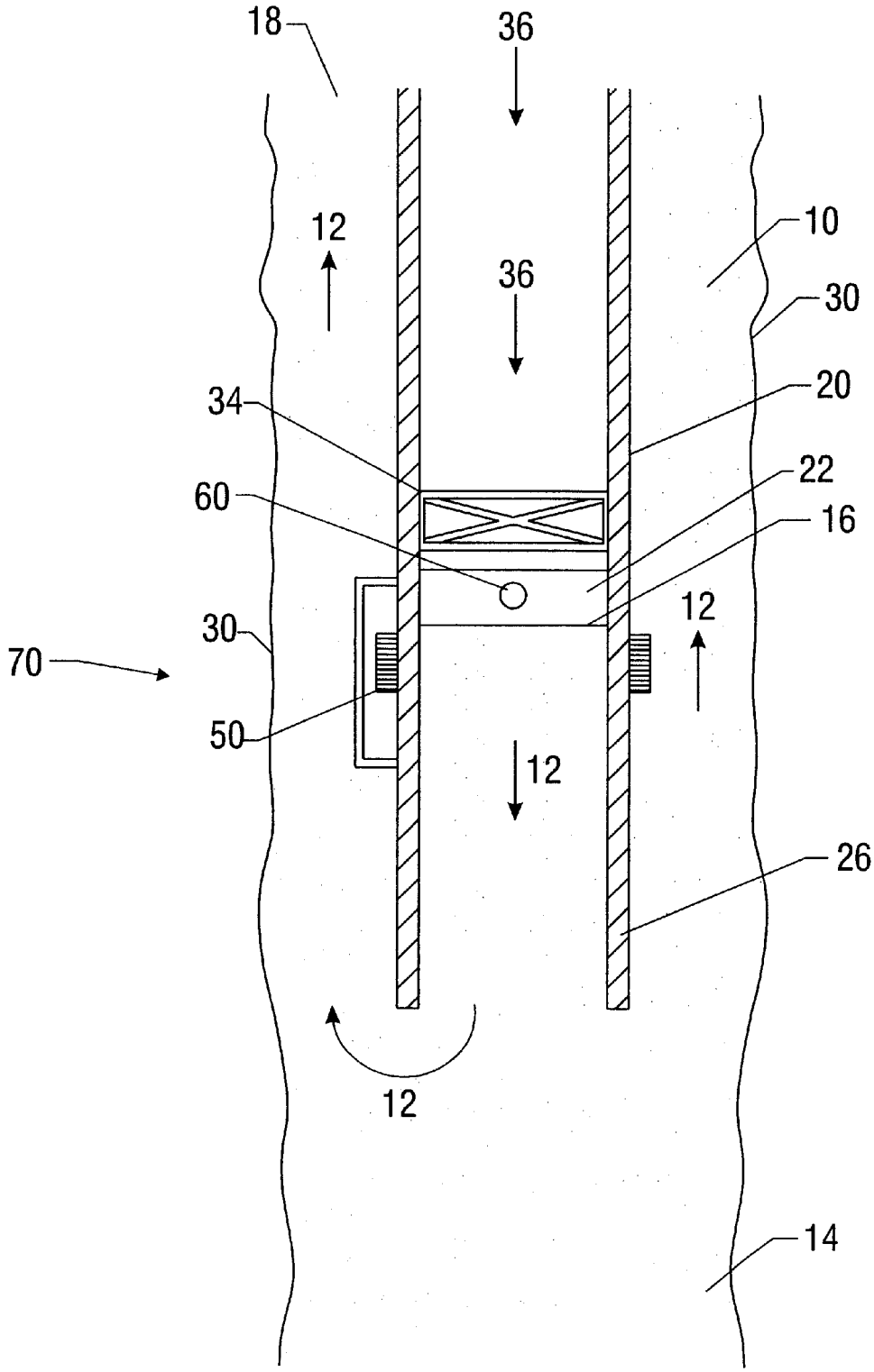
FIG. 6 shows an embodiment of the present invention that includes a rubber wiper plug.

It should also be mentioned that in the case of the conventional circulating cementing operation, transponders 62 may be embedded in a plug 22 placed at the fluid interface 16 as shown in FIG. 6.

Figure 7:
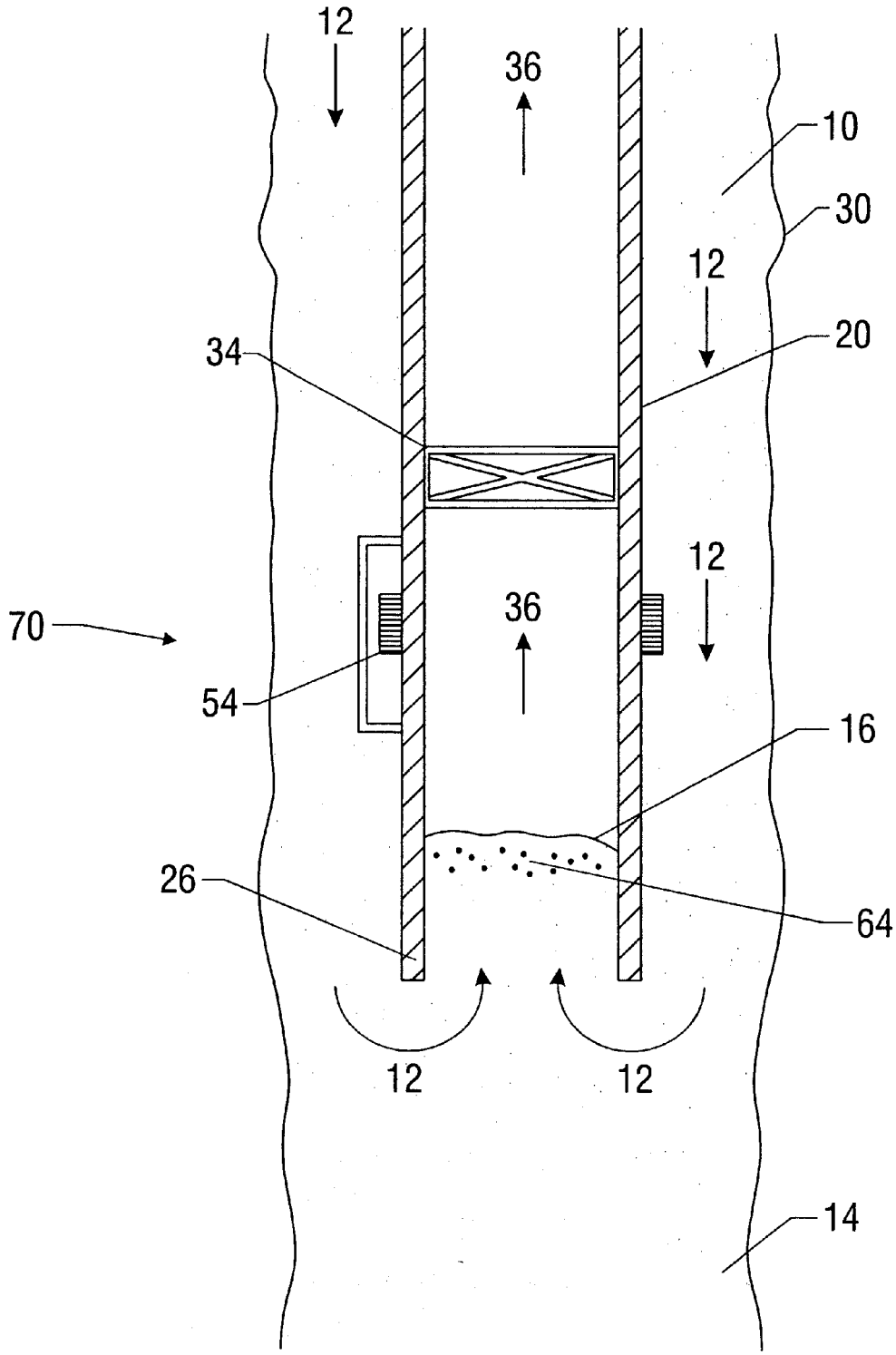
FIG. 7 shows an embodiment of the present invention that includes a hematite sensed by a magnetic sensor.

In some embodiments, as shown in FIG. 7, the sensor 50 comprises a magnetic sensor 54 attachable to the lower end 26 of casing 20. In these embodiments, the detectable device or material 60 may be comprised of Hematite 64, which is an iron oxide or other ferrous materials detectable by magnetic sensor 54.

Figure 8:
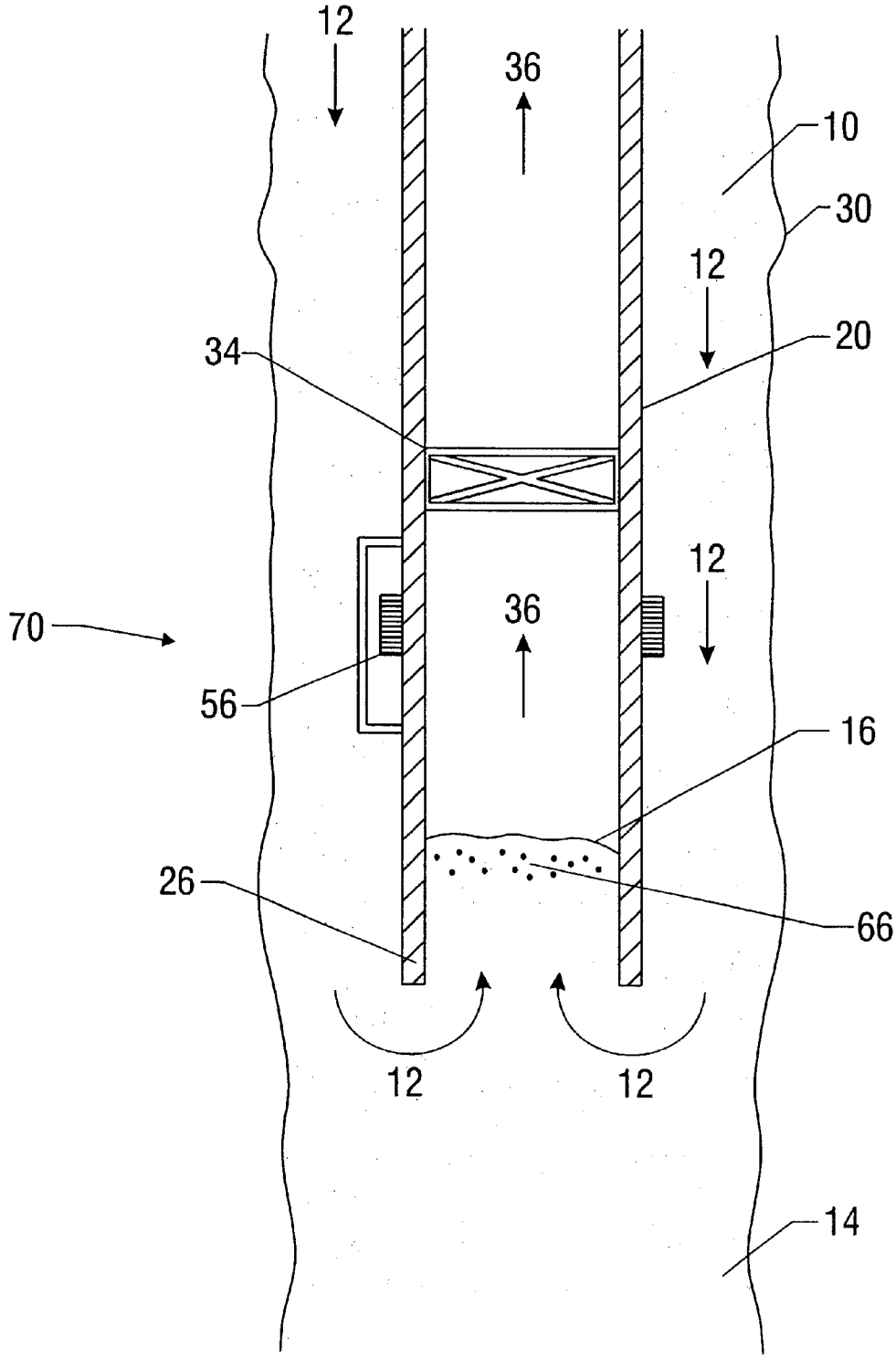
FIG. 8 shows an embodiment of the present invention that includes and isotope sensed by a Geiger counter.

In some embodiments, as shown in FIG. 8, the sensor 50 comprises a Geiger counter 56. In these embodiments, the detectable device or material 60 may be comprised of any solid or liquid radioactive isotope 66 tagged in the cement slurry near the mud/cement interface. For example, radioactive isotope 66 may be comprised of any short-lived (like 20-day half-life) isotopes such as Ir-192, I-131, or Sc-46.

Figure 9:
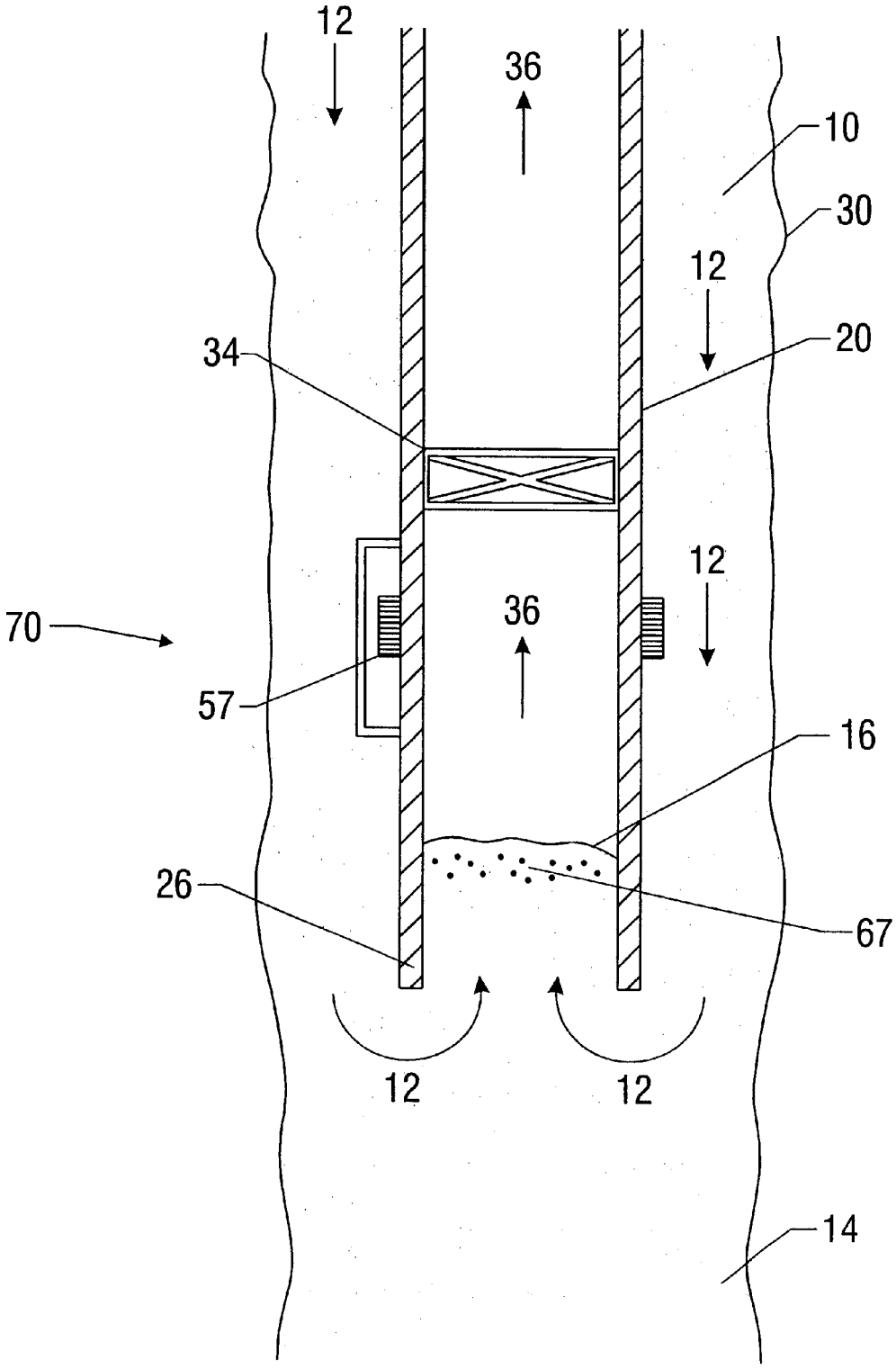
FIG. 9 shows an embodiment of the present invention utilizing a pH sensor capable of sensing a fluid having a pH value different than drilling mud and cement.

In some embodiments, as shown in FIG. 9, the sensor 50 comprises a pH sensor 57. In these embodiments, the detectable device or material 60 may be comprised of any fluids 67 having a pH that is different from each other. In some embodiments, this fluid may be comprise of fresh water drilling mud and cement.

Figure 10:
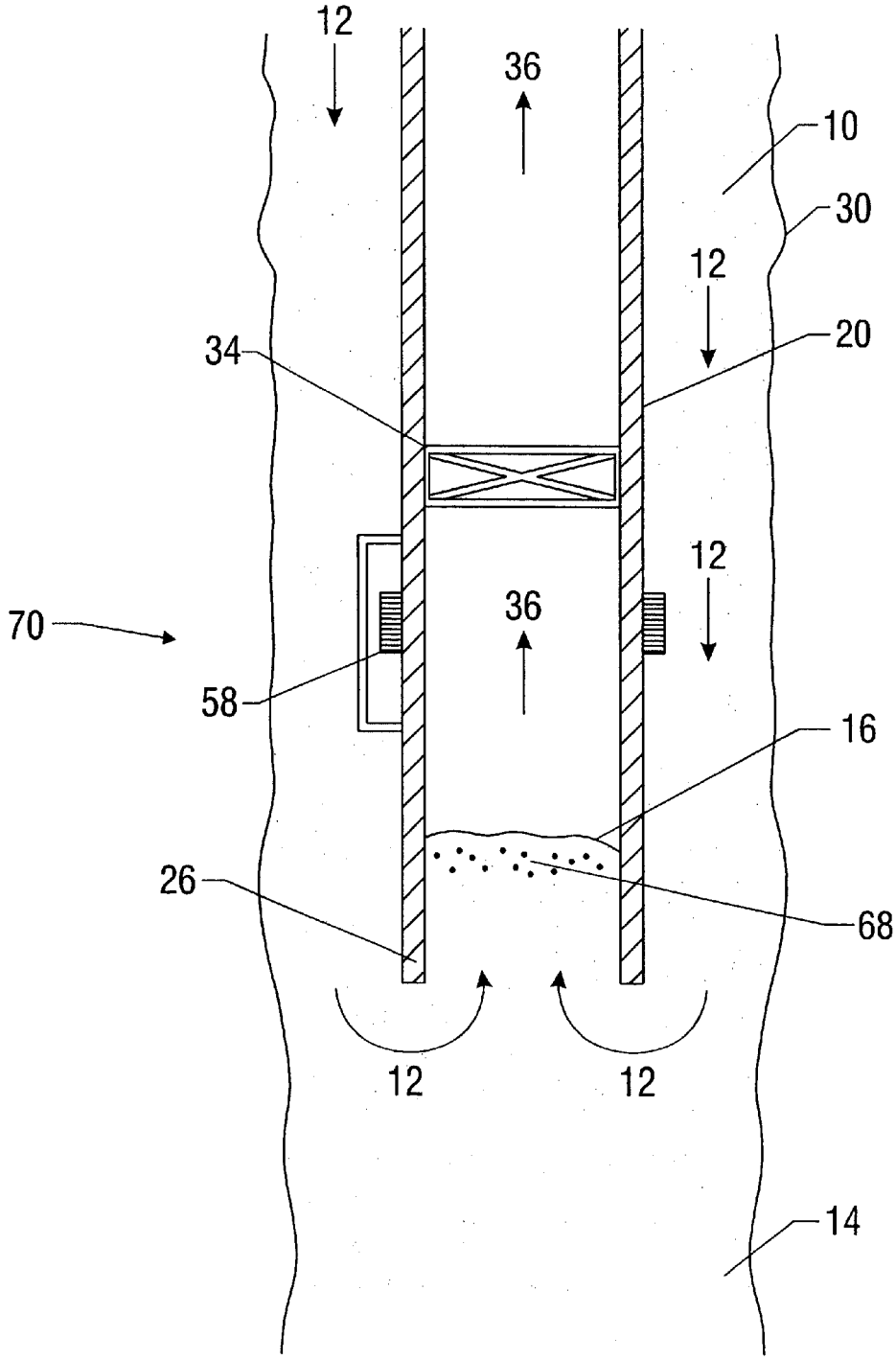
FIG. 10 shows one embodiment of the present invention utilizing a resistivity meter and fluids having different resistivity readings.

In some embodiments, as shown in FIG. 10, the sensor 50 comprises a resistivity meter 58. In these embodiments, the detectable device or material 60 may be comprised of any fluids 68 with a change in resistivity such as hydrocarbon-based spacer fluid, or a fresh water based spacer fluid, or a brine fluid.

Figure 11:
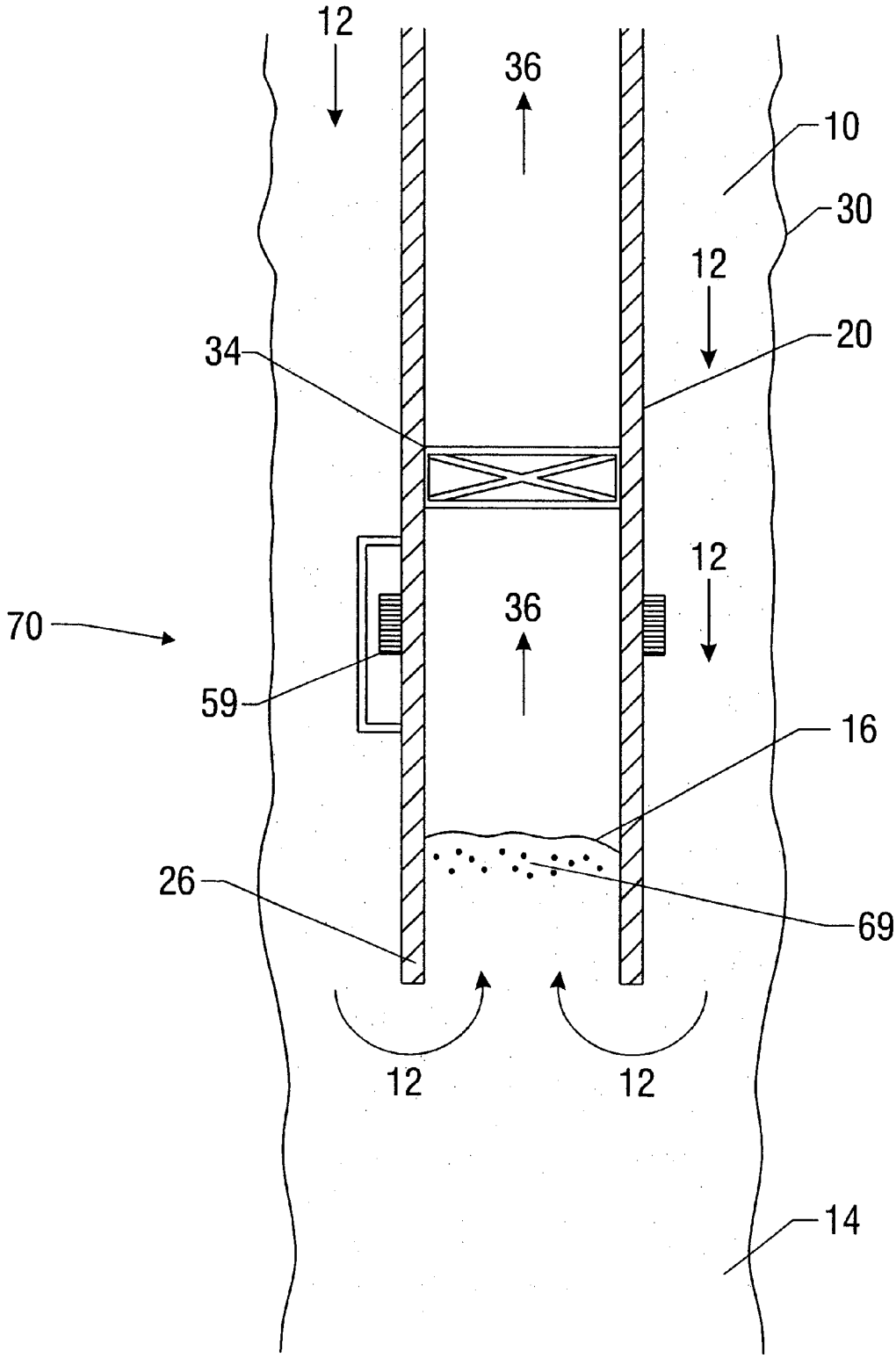
FIG. 11 shows an embodiment of the present invention utilizing a photo detector and a luminescent marker.

In some embodiments, as shown in FIG. 11, the sensor 50 comprises a photo receptor 59. In these embodiments, the detectable device or material 60 may be comprised of luminescent markers 69.

In some embodiments, the fluid interface detecting apparatus comprises a means for sensing, as well as means for traveling along the casing, the means for traveling being adjacent the fluid interface. The means for sensing may be comprised, for example, of the sensor coil 52, the magnetic sensor 54, the Geiger counter 56, the pH sensor 57, the resitivity sensor 58, or the photo receptor 59, each described above. Further, the means for traveling through the wellbore may be comprised, for example, of the transponder 62, the hematite 64, the isotope 66, the fluid having a pH different than that of the cement 67, a fluid having a resistivity different from the mud or cement 68, or luminescent markers 69 placed in the fluid interface, each as described above.

It will be appreciated by one of ordinary skill in the art, having the benefit of this disclosure, that by placing sensors at different locations on the casing, activities (other than when the mud/cement interface approaches the lower end 26 of casing 20) may be more accurately monitored in a timely fashion than with current methods.

Although various embodiments have been shown and described, the invention is not so limited and will be understood to include all such modifications and variations as would be apparent to one skilled in the art.

The following table lists the description and the numbers as used herein and in the drawings attached hereto.

| Item | Reference designator |
|---|---|
| annulus | 10 |
| cement slurry | 12 |
| reservoir | 14 |
| fluid interface | 16 |
| surface | 18 |
| casing | 20 |
| rubber wiper plug | 22 |
| lower end of casing | 26 |
| borehole | 30 |
| valve | 34 |
| drilling mud | 36 |
| sensor | 50 |
| sensor coil | 52 |
| magnetic sensor | 54 |
| Geiger counter | 56 |
| pH sensor | 57 |
| Resistivity meter | 58 |
| Photo receptor | 59 |
| detectable device | 60 |
| transponder | 62 |
| hematite | 64 |
| isotope | 66 |
| fluid with different pH | 67 |
| Fluid with resistivity difference | 68 |
| Luminescent marker | 69 |
| fluid interface detecting apparatus | 70 |
| rubber balls | 80 |
| host electronics package | 90 |

What is claimed is:

1. A circulating cementing apparatus for cementing a casing in a wellbore, the apparatus comprising:

a sensor coil adapted to be mountable around an outer perimeter of a lower end of the casing, the sensor coil disposed substantially on the lower end of the casing;

a detectable device disposed substantially adjacent a fluid interface formed between a fluid and a cement slurry, the sensor coil and the detectable device adapted to be in communication with each other as the detectable device is substantially adjacent the lower end of the casing; and a valve disposed within the casing, the sensor coil adapted to close the valve when the sensor coil and the detectable device communicate as the fluid interface reaches the lower end of the casing.

2. The apparatus of claim 1 in which the detectable device is a transponder adapted to send a Radio Frequency Identification signal to the sensor coil.

3. The apparatus of claim 2 in which the transponder is implanted into a protective device.

4. The apparatus of claim 3 in which the protective device is a rubber ball.

5. The apparatus of claim 1 further comprising a host electronics package, the host electronics package adapted to receive a signal from the sensor and to send to a signal to the valve to close the valve.

6. The apparatus of claim 1 in which the detectable device is housed within a rubber wiper plug, the rubber wiper plug being adjacent the fluid interface.

7. The apparatus of claim 1 in which the fluid is drilling mud.

8. The apparatus of claim 1 in which the fluid is water.

9. The apparatus of claim 1 in which the fluid is air.

10. A reverse circulating cementing apparatus for cementing a casing in a wellbore, the casing and the wellbore defining an annulus therebetween, the apparatus comprising:

a sensor coil disposed substantially on a lower end of the casing, the sensor coil adapted to be mountable around an outer perimeter of lower end of the casing;

a transponder device disposed substantially adjacent a fluid interface formed between a first fluid and a cement slurry, the sensor coil adapted to detect the transponder as the transponder approaches the lower end of the casing, the transponder being implanted into a protective rubber ball, the transponder adapted to send a Radio Frequency Identification signal to the sensor coil;

a valve disposed within the casing; and a host electronics package adapted to receive a signal from the sensor coil and to send to a signal to the valve to close the valve, the host electronics package functionally adapted to close the valve when the sensor coil detects the transponder and sends a signal to the host electronics package when the fluid interface approaches the lower end of the casing as the cement is pumped down the annulus.

11. The apparatus claim 10 in which the first fluid is drilling mud.

12. The apparatus of claim 10 in which the first fluid is water.

13. The apparatus of claim 10 in which the first fluid is air.

14. A reverse circulating cementing apparatus for cementing a casing in a wellbore, the casing and the wellbore defining an annulus therebetween, the apparatus comprising:

a sensor coil disposed substantially on a lower end of the casing, the sensor coil adapted to be mountable around an outer perimeter of lower end of the casing;

a transponder device disposed substantially adjacent a fluid interface formed between a first fluid and a cement slurry, the sensor coil adapted to detect the transponder as the transponder approaches the lower end of the casing, the transponder adapted to send a Radio Frequency Identification signal to the sensor coil;

a valve disposed within the casing; and a host electronics package functionally adapted close the valve when the host electronics package receives a signal from the sensor coil and sends a signal to the valve to close the valve, when the sensor coil detects the transponder and sends a signal to the host electronics package, when the fluid interface approaches the lower end of the casing as the cement is pumped down the annulus.

15. The apparatus of claim 14 in which the transponder is implanted into a protective rubber ball.

16. The apparatus of claim 14 in which the first fluid is drilling mud.

17. The apparatus of claim 14 in which the first fluid is water.

18. The apparatus of claim 14 in which the first fluid is air.

* * * * *